US005454212A

United States Patent [19]

Tanaka

[11] Patent Number: 5,454,212

[45] Date of Patent: Oct. 3, 1995

[54] METHOD AND APPARATUS FOR TRANSFERRING GOODS TO CONTAINERS

[75] Inventor: Nobuhiro Tanaka, Saitama, Japan

[73] Assignee: Kao Corporation, Tokyo, Japan

[21] Appl. No.: 208,126

[22] Filed: Mar. 8, 1994

[30] Foreign Application Priority Data

Mar. 11, 1993 [JP] Japan ..... 5-076445

[51] Int. Cl.[6] ..... B65B 1/04; B65B 59/00; B65B 35/00; B65B 35/50

[52] U.S. Cl. ..... 53/473; 53/447; 53/445; 53/252; 53/474; 53/534

[58] Field of Search ..... 53/445, 447, 443, 53/473, 475, 474, 534, 244, 252, 247, 537, 260, 240, 238

[56] References Cited

U.S. PATENT DOCUMENTS

| | | | |
|---|---|---|---|
| 3,585,782 | 6/1971 | Staley | 53/244 |
| 3,687,446 | 8/1972 | Neumann et al. . | |
| 4,203,274 | 5/1980 | Warkentin et al. | 53/244 |
| 4,608,808 | 2/1986 | Ryan et al. . | |
| 4,827,692 | 5/1989 | Fiske et al. | 53/244 |
| 4,905,456 | 3/1990 | Olacchoa | 53/475 |

FOREIGN PATENT DOCUMENTS

| | | |
|---|---|---|
| 0189693 | 8/1986 | European Pat. Off. . |
| 63-100415 | 6/1988 | Japan . |
| 698890 | 10/1953 | United Kingdom . |

OTHER PUBLICATIONS

Soviet Patents Abstracts, Section PQ, Week 9103, 6 Mar. 1991, Derwent Publications Ltd., London, Great Britain; Class Q31, AN 91-020409.

*Primary Examiner*—John Sipos
*Assistant Examiner*—Rodney A. Butler
*Attorney, Agent, or Firm*—Dvorak and Traub

[57] ABSTRACT

In a method of transferring goods into a container 83, the container 83 is tilted toward a goods loader 18, and a goods transferring member 90 with goods accommodated therein is inserted into an upper empty space in the tilted container 83. Thereafter, the goods transferring member 90 is tilted downward, and in this tilted state, it is withdrawn to the outside of the container 83, thus effecting the transfer of the goods in it into the container 83.

8 Claims, 12 Drawing Sheets

METHOD AND APPARATUS FOR TRANSFERRING GOODS TO CONTAINERS

BACK GROUND OF THE INVENTION

1. Field of the Invention

The present invention relates to a method and an apparatus for transferring goods to containers.

2. Description of the Back ground Art

There is known in the prior art, a goods loader, in which goods on a goods transferring member are transferred to an empty container by a goods push-plate. Also, known is a goods collection system, in which a goods loader is provided at each of a plurality of positions along a container conveying line for transferring successive goods to containers with the individual goods loaders.

In the prior art, however, there are the following problems.

① Since goods on a goods transferring member are pushed by the goods push-out plate toward the container so that they fall thereinto, the goods can not be transferred in a neatly arranged form.

② Goods received by a conveyor can be transferred only to empty containers. Therefore, it is impossible to successively transfer goods having been received in a plurality of goods receptacles on the conveyor to a next conveyor or to add goods to a container, which also contains goods transferred from a different goods collection unit. Therefore, it is possible to accommodate only a small quantity of goods in the container, and the goods accommodation efficiency is low. Further, a large number of containers are necessary, and the goods collection capacity is low.

③ When containers are successively conveyed toward a plurality of goods loaders, they are held in a horizontal state. Therefore, unstable goods, such as flat bolts, are turned down in the container in a conveying process after they have been transferred into the container. The form of arrangement of goods in the container is thus readily disturbed to deteriorate the performance of handing goods in the subsequent steps.

SUMMARY OF THE INVENTION

It is an object of the present invention is to permit, when transferring goods from a goods transferring member to a container, transferring the goods in a neatly arranged form to the container and also adding goods to the container which already contains goods.

It is another object of the present invention is to permit, when successively conveying containers toward a plurality of goods loaders, conveying the containers without disturbing the form of arrangement of goods contained in the containers.

According to the invention, there is provided a method of transferring goods to containers with goods loaders, which comprises the steps of tilting a container toward the goods loader, inserting a goods transferring member with goods accommodated therein into an upper empty space in the tilted container, and then tilting the goods transferring member downward and withdrawing the goods transferring member in the tilted state to the outside of the container, thus effecting the transfer of the goods in the goods transferring member to the container.

Further according to the invention, there is provided a method of transferring goods to containers in which the goods loader is disposed at each of a plurality of positions along a conveying line for conveying the containers therealong, the containers being conveyed between adjacent goods loaders in a state tilted toward the goods loaders while goods are successively transferred to the containers by each goods loader.

Further according to the invention, there is provided a goods transfer apparatus for transferring goods to containers with a goods loader, which comprises a container orientation controller for tilting a container toward the goods loader, a goods transferring member for accommodating goods, and a goods transferring member operating unit for permitting inserting the goods transferring member into an upper empty space in the tilted container, tilting the goods transferring member downward and withdrawing the goods transferring member in the tilted state to the outside of the container.

Further according to the invention, there is provided a goods transfer apparatus for transferring goods from a goods reception conveyor to containers with a goods loader, which comprises a container orientation controller for tilting a container toward the goods loader, and a goods transferring member for accommodating goods, the goods loader serving to push goods collected in the goods reception conveyor with push-out means at a goods discharge position so as to push out the goods to a goods feeder unit disposed sidewise so that the goods can be transferred from the goods feeder unit to a container, the goods feeder unit including a slide driver for causing movement of the goods transferring member to given extents in the both directions of the goods receptacle member and the container, a tilt driver for causing the goods transferring member to be tilted together with the slide driver, a tilt base slide driver for causing the goods transferring member to be moved to a predetermined extent together with the slide driver and the tilt driver, a revolution driver for causing the goods transferring member to be revolved by 180 degrees together with the slide driver, the tilt driver and the tilt base slide driver from a state directed to the goods reception conveyor to a state directed to the container, and a lifter for raising and lowering the goods transferring member together with the slide driver, the tilt driver, the tilt base slide driver and the revolution driver to change the level height of the goods transferring member, thereby raising and lowering the position of insertion of the goods transferring member into the container.

Further according to the invention, there is provided a method of collecting goods in a container using a goods transfer apparatus and which comprises the steps of causing the goods transferring member to be projected toward the goods reception conveyor with the slide driver for receiving goods pushed out from the conveyor, after the transfer of the goods to the goods transferring member, the goods transferring member to be withdrawn toward the container with the slide driver, carrying out either step (a) when the container is still empty or step (b) when the container is not empty. In the step (a) the goods transferring member is caused to be revolved by 180 degrees toward the container. In the step (b) the goods transferring member is to be revolved by 180 degrees toward the container and at the same time caused by the lifter to be raised up to a position above goods having already been inserted in the container, then causing the goods transferring member to be moved and inserted into the container by the slide driver, and then causing the goods transferring member to be tilted together with the slide driver by the tilt driver, thus causing the goods to be supported by the bottom of the container. The goods transferring member is then caused to be moved away from the container by the slide driver, thus withdrawing the goods transferring member while leaving the goods alone in the container, and returning the tilt driver, after the withdrawal of the goods transferring member, and causing the goods transferring member to be revolved by 180 degrees toward the goods reception conveyor by the revolution driver, thus returning the goods transferring member to the initial position.

According to the invention, the following functions are obtainable.

① By inserting the goods transferring member with goods accommodated therein into an upper empty space in the tilted container and then withdrawing the goods transferring member in the state thereof tilted downward to the outside of the container, goods can be inserted into the container while they are held in their form (i.e., arranged form) on the goods transferring member.

② When the container already contains goods having been inserted earlier, with the tilting of the container, the goods contained therein are brought toward the lower side wall of the container, thus forming an upper empty space therein. This empty space can serve as a space, into which subsequent goods may be inserted as additional goods in the manner as shown in ①. Thus, it is possible to transfer goods received in a plurality of good receptacles on the conveyor successively into one container or adds goods to the container which already contains goods having been transferred from a goods collection unit. It is thus possible to improve the accommodation efficiency of the container and also the goods collection capacity of the goods collection line.

According to the invention, the following function is obtainable.

By conveying the container between adjacent goods loaders in a state tilted toward the goods loaders, the goods contained in the container can be conveyed to the next goods loader in a state brought to the lower side wall of the container. Thus, even unstable goods, such as flat bolts, can be conveyed without possibility of being turned down in the container. Thus, the arranged form of goods can be maintained, and the property of handling goods in the following process can be improved. Further, since the goods in the container are not turned down, it is possible to stably form, in an upper portion of the container, an empty space, into which additional goods are to be inserted in the next goods loader.

BRIEF DESCRIPTION OF THE DRAWINGS

The present invention will be more fully understood from the detailed description given below and from the accompanying drawings which should not be taken to be a limitation on the invention, but for explanation and understanding only.

The drawings.

DESCRIPTION OF THE PREFERRED EMBODIMENT

Figure 1:
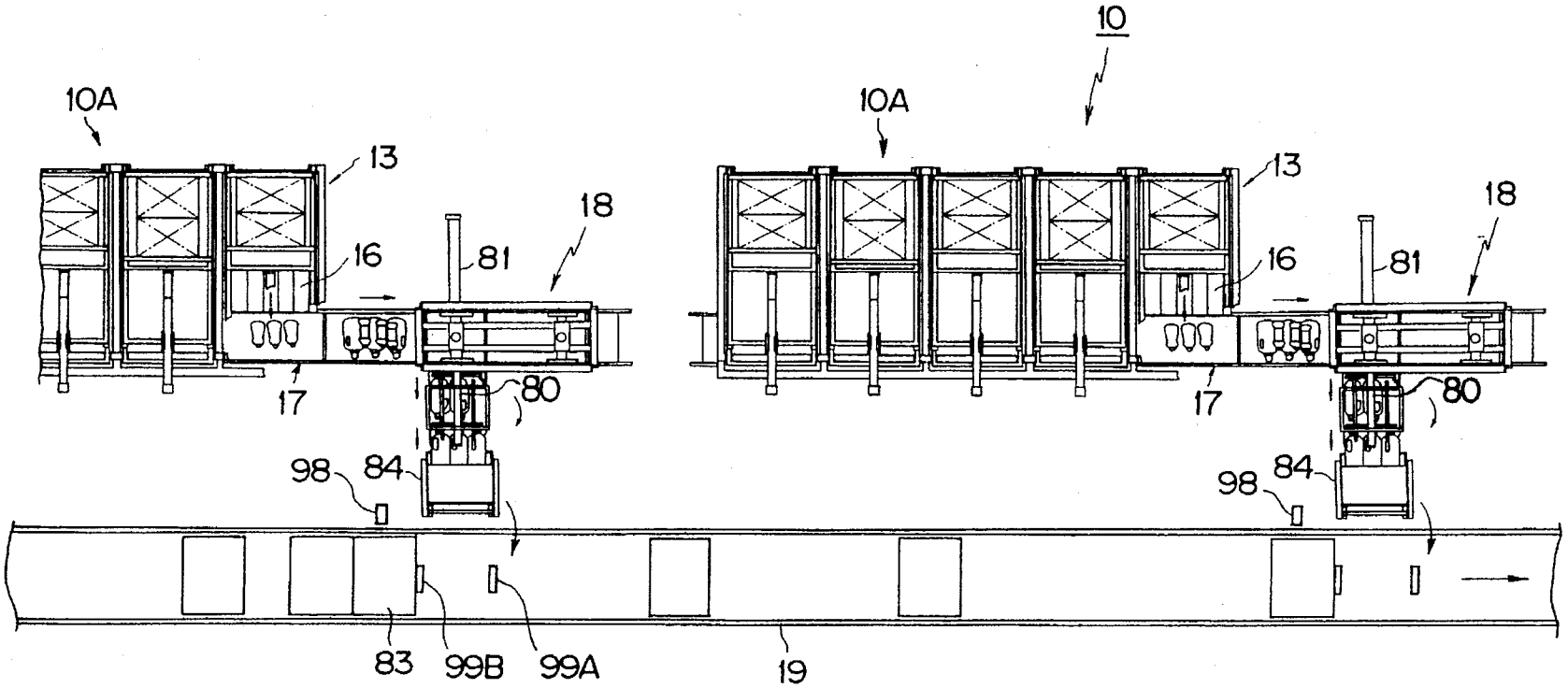
FIG. 1 is a schematic view showing a plurality of goods collection units provided along a container conveying line.

FIG. 1 shows a picking apparatus 10 according to the invention. The apparatus comprises a goods collection unit 10A including goods take-out units 13, goods drop-out units 14, a guide chute 15, a stationary chute 16, a goods reception conveyor 17, and a goods loader 18. The goods collection unit 10A is disposed at each of a plurality of positions along a container transferring line 19 for conveying the container therealong, the goods are successively transferred to the containers 83 by each goods loader 18 of the good collection unit 10A. The individual components of the apparatus will now be described in detail.

Figure 2:
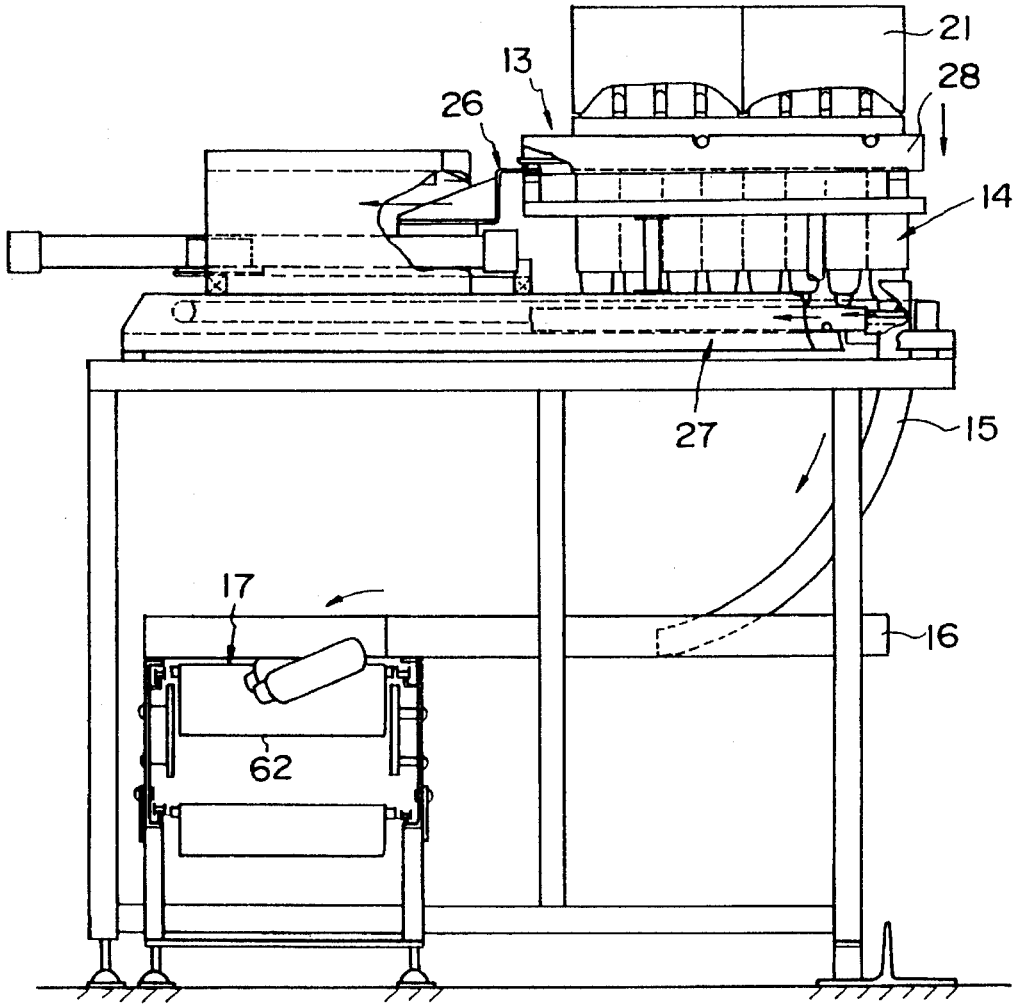
FIG. 2 is a schematic view showing a state of dropping out goods from a goods drop-out unit.
Figure 3:
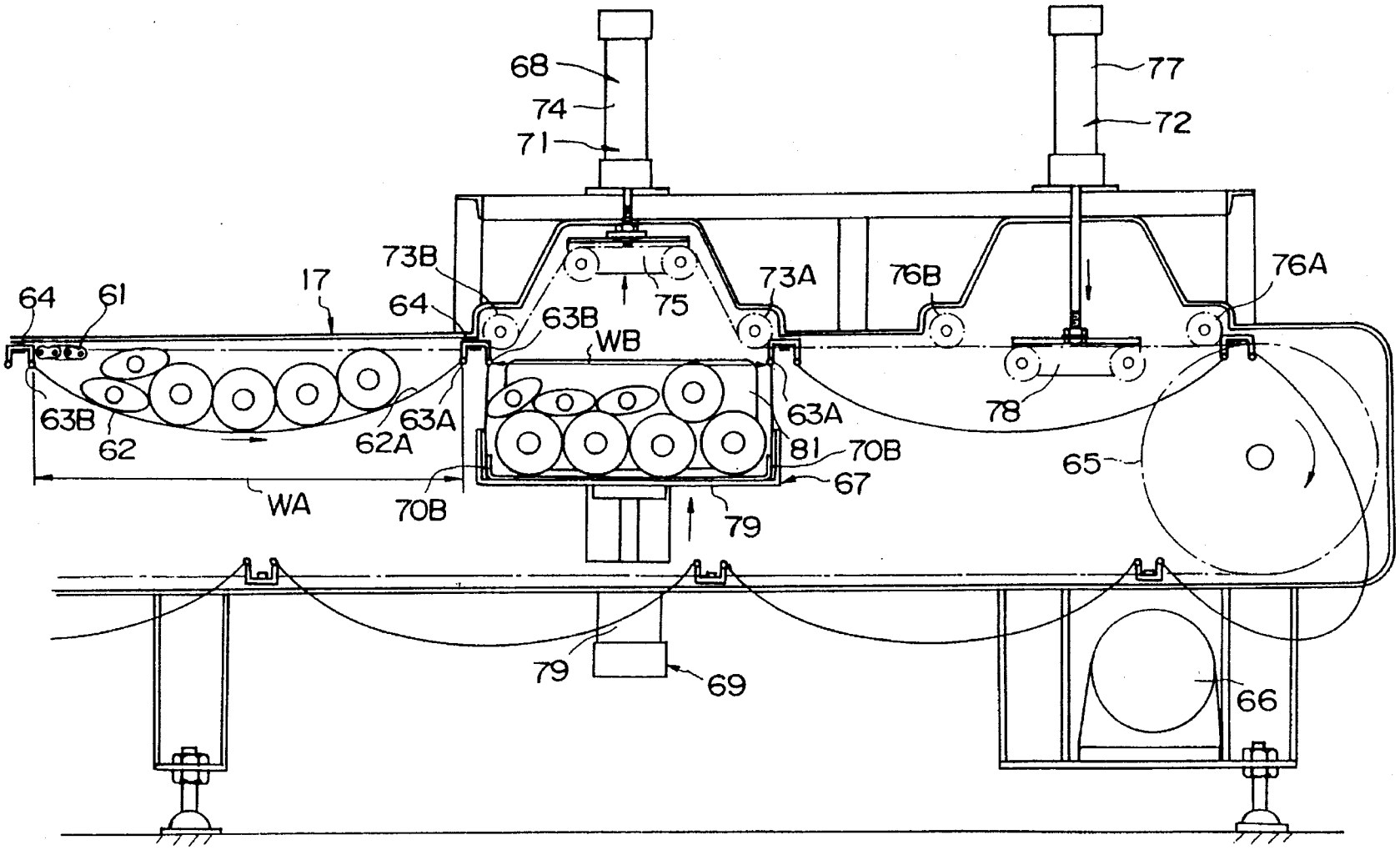
FIG. 3 is a schematic view showing a distance adjuster for adjusting the distance between support points of a goods receptacle member provided on a goods reception conveyor.
Figure 4A:
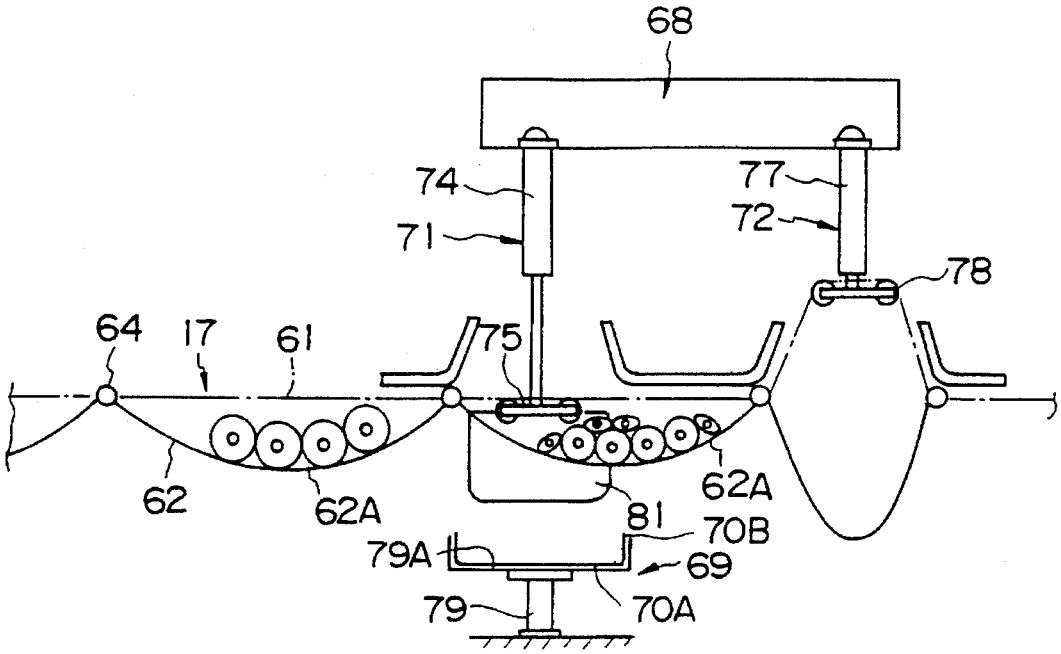
FIGS. 4A and 4B are schematic views showing the operation of the distance adjuster.
Figure 4B:
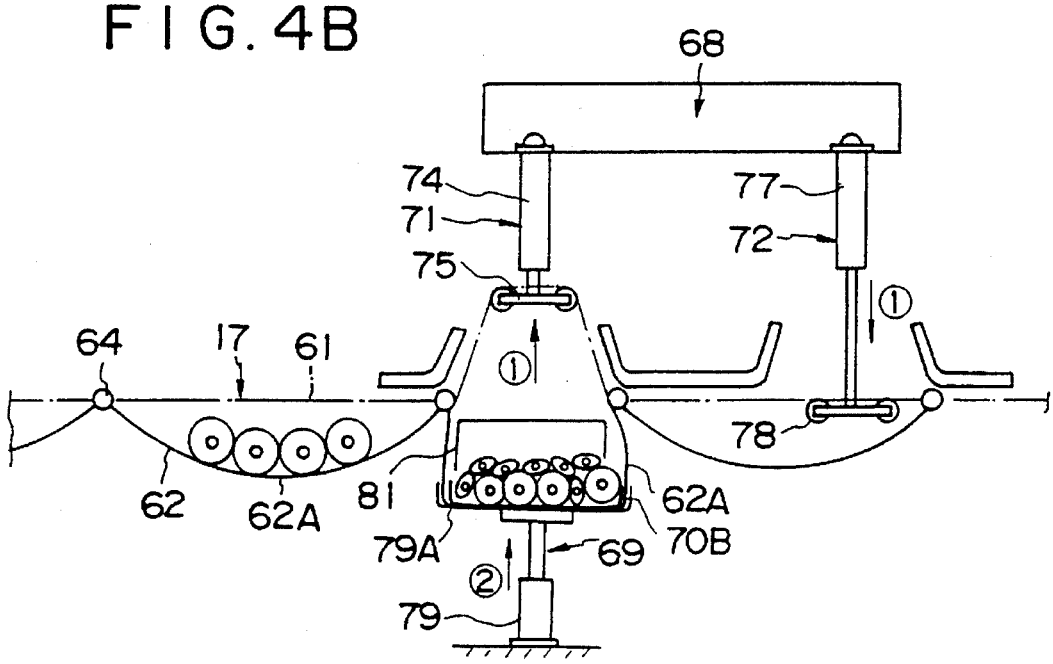

(A) Goods take-out unit 13 and goods drop-out unit 14 (FIGS. 1 and 2)

A goods take-out unit 13 and a goods drop-out unit 14 are coupled together as a set. The picking apparatus 10 has sets of goods take-out and drop-out units 13 and 14 corresponding in number to the number of (for instance first to twentieth) goods storage zones of the flow shell i.e., to the number of (for instance twenty) different kinds of goods.

Each goods take-out unit 13 is capable of mounting and dismounting on and out of the top of the adjoining goods drop-out unit 14. After all the goods contained in a cardboard case 21 mounted in the goods take-out unit 13 have been transferred to the lower goods drop-out unit 14 by opening a shutter device 26 of the goods take-out unit 13, a desired number of goods may be dropped out to the side of a guide chute 15 by opening a shutter device 27 of the goods drop-out unit 14.

(B) Guide chute 15 and stationary chute 16 (see FIG. 1)

The stationary chute 16, as shown in FIG. 2, is disposed beneath each goods drop-out unit 14 and over the entire width (drop-out width) thereof. The rear end of the stationary chute 16 is found directly beneath the drop-out openings of the goods drop-out unit 14, and its front end projects forward from a position beneath the drop-out openings of the goods drop-out unit 14 and faces the goods reception conveyor 17.

The guide chute 15, as shown in FIG. 2, extends from the drop-out openings of the goods drop-out unit 14 to the top surface of the stationary chute 16 for smoothly guiding goods dropped out and falling from the drop-out openings of the good drop-out unit 14 to the stationary chute 16.

(C) Goods reception conveyor (see FIGS. 2 to 6)

The goods reception conveyor 17 extends along a goods collection path (goods conveying path), which is set to extend from a position corresponding to the front of the guide and stationary chutes 15 and 16 connected to each goods drop-out unit 14 noted above to a position corresponding to a goods loader 18.

The goods reception conveyor 17 has an endless support member (such as chains) 61 which is capable of excursion along the goods collection path. The support member 61 is provided at a plurality of positions along the conveying direction with flexible goods receptacle members (such as belts) 62. Each goods receptacle member 62 has its upstream and downstream support points 63A and 63B in the conveying direction supportedly coupled via pin joints to struts 64 provided at a predetermined interval on the support member 61. It is suspended in a flexible U-shaped form to form a U-shaped goods receptacle 62A. The flexible goods receptacle member 62 is set such that the goods reception width (opening width) WA of the U-shaped goods receptacle 62A in front of the stationary chute 16 is the same as the width of the stationary chute 16 (i.e., opening width of each goods drop-out unit 14).

Alternatively, the individual goods receptacle members 62 may be formed continuously by a single belt member covering the entire length of the support member 61, with an upstream and a downstream support point 63A and 63B provided for each U-shaped goods receptacle 62A bolted to struts 64.

The goods reception conveyor 17 is driven by a motor 66, which drives a drive wheel 65 with the support member 61 passed thereround. Under control of the pick-up controller, the support member 61 is driven intermittently in a timed relation to the drop-out of goods from the goods drop-out unit 14. The goods receptacle members 62 are thus pitch fed at an interval corresponding to the width of the U-shaped goods receptacle 62A, and thus they are brought one after another to a position in front of each stationary chute 16. The goods reception conveyor 17 moves while collecting goods dropped out from each goods drop-out unit 14 in each goods collection section 62A via each stationary chute 16.

The pick-out controller previously determines the kinds and quantities of goods to be collected in the individual goods receptacle member 62 of the goods reception conveyor 17 according to the quantity of goods accommodated in the U-shaped goods receptacles 62A. The goods reception conveyor 17 is thus brought to successive positions in front of the individual stationary chutes 16 to collect goods into the goods receptacle members 62 via the stationary chutes 16. After attaining the goods collection plan, it proceeds toward the goods discharge position.

The goods collection plan with respect to the individual goods receptacle members 62 of the goods reception conveyor 17 is executed, for instance, as in (1) to (3) below.

(1) When there are orders from shops A, B, . . . as in Table 1 below, the kinds and quantities of goods to be collected in goods receptacle members ① to ④ are determined such that the amount of goods accommodated in the goods receptacle members 62 is 40 L or less. Here, one goods receptacle member is not assigned for orders of two or more shops. In addition, two or more goods receptacle members are not assigned to the same kind of goods.

(2) Then, a drop-out amount data is supplied to each goods drop-out unit 14 in a timed relation to the pitch feed of the goods reception conveyor 17. Specifically, when the goods receptacle member ① arrives at a first goods drop-out unit 14 (for a good type a), a drop-out quantity data of 6 goods is supplied to the first goods drop-out unit 14. If there are other goods receptacle members in front of other goods drop-out units 14 for receiving dropped-out goods, corresponding drop-out quantity data are also supplied.

(3) The goods drop-out units 14 which have received the drop-out quantity data, drop out the instructed quantities of goods.

As an alternative, it is possible to preliminarily supply drop-out quantity data and instruct the drop-out timings.

TABLE 1

| | kind (Section) | Quantity | | Goods storage amount | Assigned goods receptacle member |
|---|---|---|---|---|---|
| Shop A | a (1) | 6 | 6L | | |
| | b (3) | 12 | 10L | 18L | →① |
| | c (7) | 6 | 2L | | |
| | d (8) | 6 | 8L | | |
| | e (9) | 3 | 2L | 15L | →② |
| | f (11) | 6 | 5L | | |
| | g (15) | 6 | 4L | | →③ |
| | | | | 6L | |
| | h (20) | 3 | 2L | | |
| Shop B | — | — | — | | —④ |

In the goods reception conveyor 17, a U-shaped form adjuster 67, which permits adjustment of the U-shaped form of the goods receptacle 62A formed by the goods receptacle member 62, is provided at a goods discharge position (i.e., goods collection position) which is disposed downstream of the stationary chutes 16. The U-shaped form adjuster 67 includes a support point distance adjuster 68 for adjusting the distance between the upstream and downstream support points 63A and 63B of each goods receptacle member 62, a raiser 69 for raising the U-shaped goods receptacle 62A and an opening unit 70 for outwardly opening the opposite sides of the bottom of the goods receptacle member 62.

The support point distance adjuster 68 has a first and a second support member raiser 71 and 72. The first support member raiser 71 is disposed above the goods discharge position and includes a pulley row 75 which is vertically movable by a cylinder 74. The pulley row 75 can raise a portion of the support member 61 that is found between an upstream and a downstream pulley 73A and 73B spaced apart a distance smaller than the width of the U-shaped goods receptacle 62A to an upper position above the usual conveying path. As a result, the distance between the upstream and downstream support points 63A and 63B of the goods receptacle member 62 that is located at the goods discharge position is changed to a discharge width WB smaller than the goods receptacle member width noted above. The second support member raiser 72 is disposed downstream the first support member raiser 71 and includes a vertically movable pulley row 78 which is vertically movable by a cylinder 77. The pulley row 78 can return the portion of the support member 61 between an upstream and a downstream pulley 76A and 76B spaced apart the same distance as the distance between the pulleys 73A and 73B noted above from the raised position to the level of the normal conveying path. As a result, the redundant length of the support member 61 that has been held at the raised position by the second support member raiser 72, is converted to the length of raising by the first support member raiser 71. Thus, it is possible to alter the distance between the upstream and downstream support points 63A and 63B of the goods receptacle member 62 without loosening the length of the travel of the support member 61.

The support point distance adjuster 68, in a goods conveying mode (see FIG. 4A), is set by setting the first support member raiser 71 to the normal goods conveying path and setting the second support member raiser 72 to the raised position, the goods receptacle member 62 is moved to bring the U-shaped goods receptacle 62A to the goods discharge position. Then the mode is switched over to a goods discharging mode (see FIG. 4B) by setting the first support member raiser 71 to the raised position again and setting the second support member raiser 72 to the normal goods conveying path, and in this mode the U-shaped form of the goods receptacle 62A is adjusted to a narrow width suited for the handling in the discharge place or station by setting the distance between the upstream and downstream support points 63A and 63B of the goods receptacle member 62.

The raiser 69 has a channel shaped plate 79A, which is disposed beneath the goods discharge position and vertically movable by a cylinder 79. It serves to raise the lower side of goods receptacle member 62 that has been adjusted to the width WB and thereby sets the form of the goods in the goods receptacle 62A to a form suited for the handling in the discharge place or station (i.e., form suited to the form of opening of a container 83 (see FIG. 4B).

The raiser 69 sets the level of discharge of goods in the goods receptacle member 62 to the goods reception level of a goods reception table 80.

Figure 6:
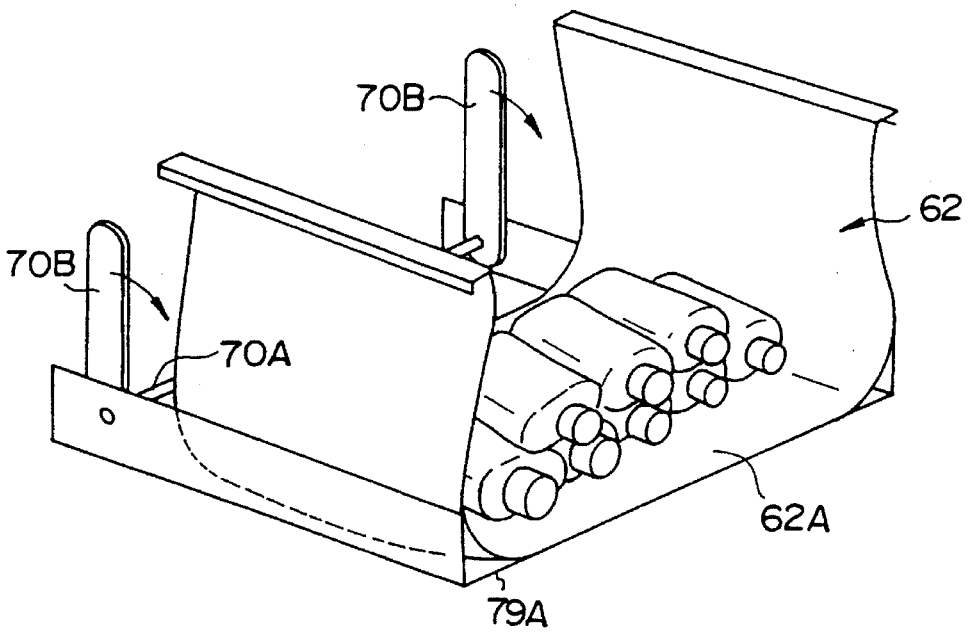
FIG. 6 is a schematic view showing an opening unit for the goods receptacle member.
Figure 6:
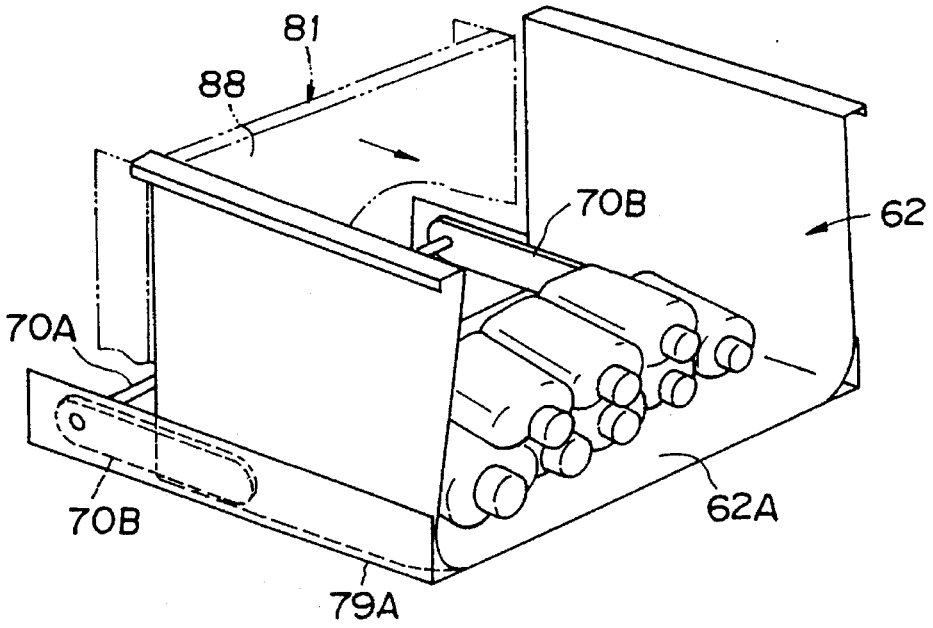

An opening unit 70, as shown in FIG. 6, includes a shaft 70A, which is rotatably provided in one end of each of the opposite end flange portions of the channel-shaped plate 79A of the raiser 69. A pair of plate-like retaining member 70B are secured to the opposite ends of the shaft 70A. A central portion of the shaft 70A has an arm 70C, which is coupled to an opening cylinder 70D trunion supported by the plate 79A. In the opening unit 70, the retaining member 70B are adapted to be rocked 90 degrees and thus turned toward the goods receptacle member 62 by causing rocking of the arm 70C and shaft 70A with the opening cylinder 70D. Thus, the opening unit 70 can form a rectangular opening for inserting the push-out means 81 in one side opening of the goods receptacle member 62 having been raised by the plate 79A by holding the opposite comers of the bottom of the goods receptacle member 62 on the side of the push-out means 81 and thereby holding opposite sides of the bottom of the goods receptacle member 62 open outward.

The plate 79A need not be channel-shaped as above; for example, the plate 79A may be provided on its opposite sides with grooves to be engaged with the retaining members 70B such that the opposite comers of the goods receptacle member 62 may be pushed into these grooves. With this arrangement, the rectangular opening may be formed more reliably in one side opening of the goods receptacle member 62. Further, more reliable formation of the rectangular opening in one side opening of the goods receptacle member 62, the goods receptacle member 62 may be provided such that (a) a notch is formed in each bottom corner or (b) the opposite bottom comers may be cut out and then the cut corner portions may be sewn together to form a seam.

Further, the opening unit 70 need not include the retaining members 70B; for example, the opposite bottom comers of the goods receptacle member 62 may be adapted to be sucked from the outer side so as to have neighborhoods of the opposite bottom comers open outward. The opening unit may be constructed with vacuum suction means or magnetic attraction means as well. Further, it is possible to instruct the raiser 69 to construct the opening unit 70.

Figure 5:
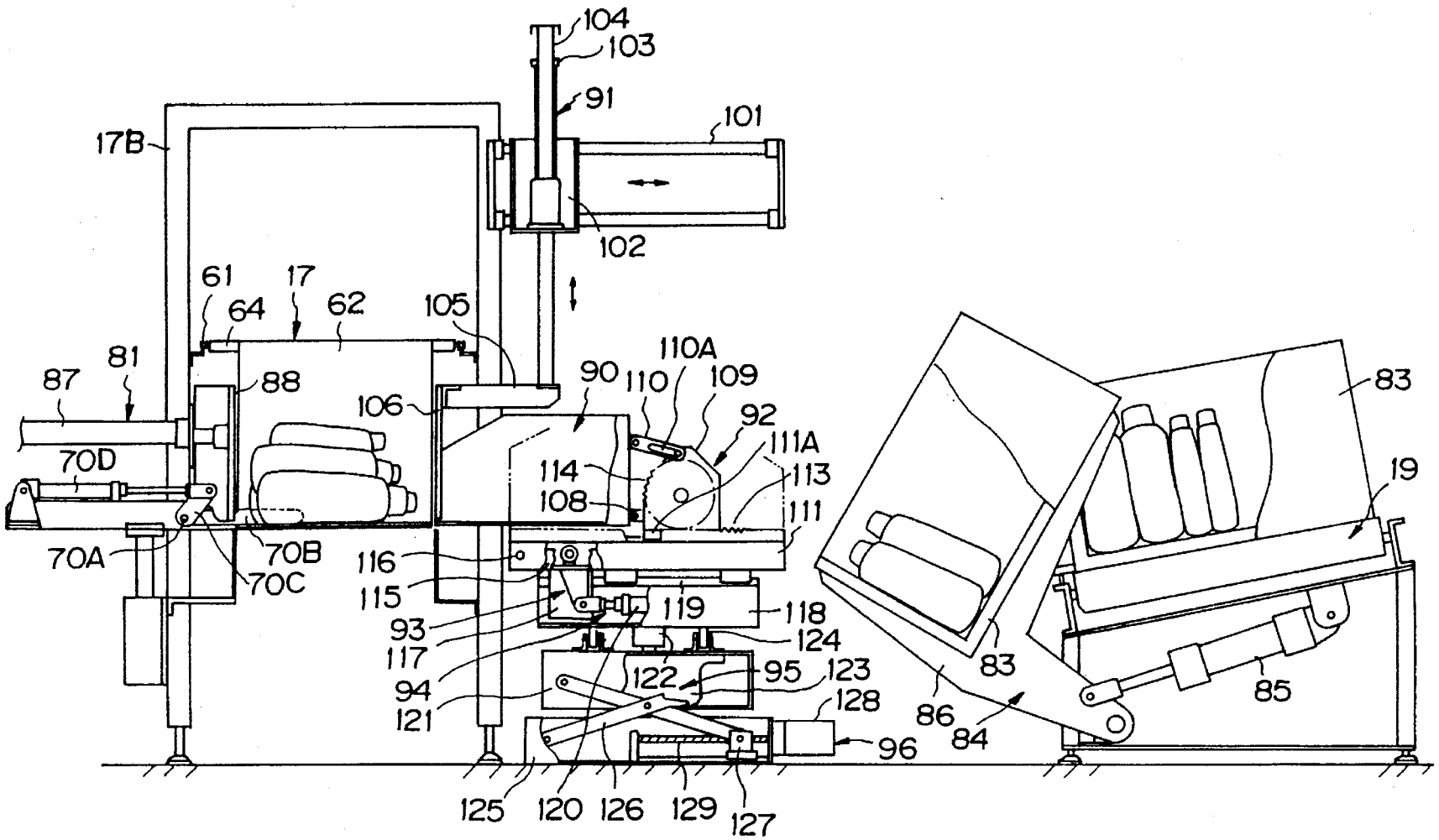
FIG. 5 is a schematic view showing a goods discharge/transfer unit.
Figure 7:
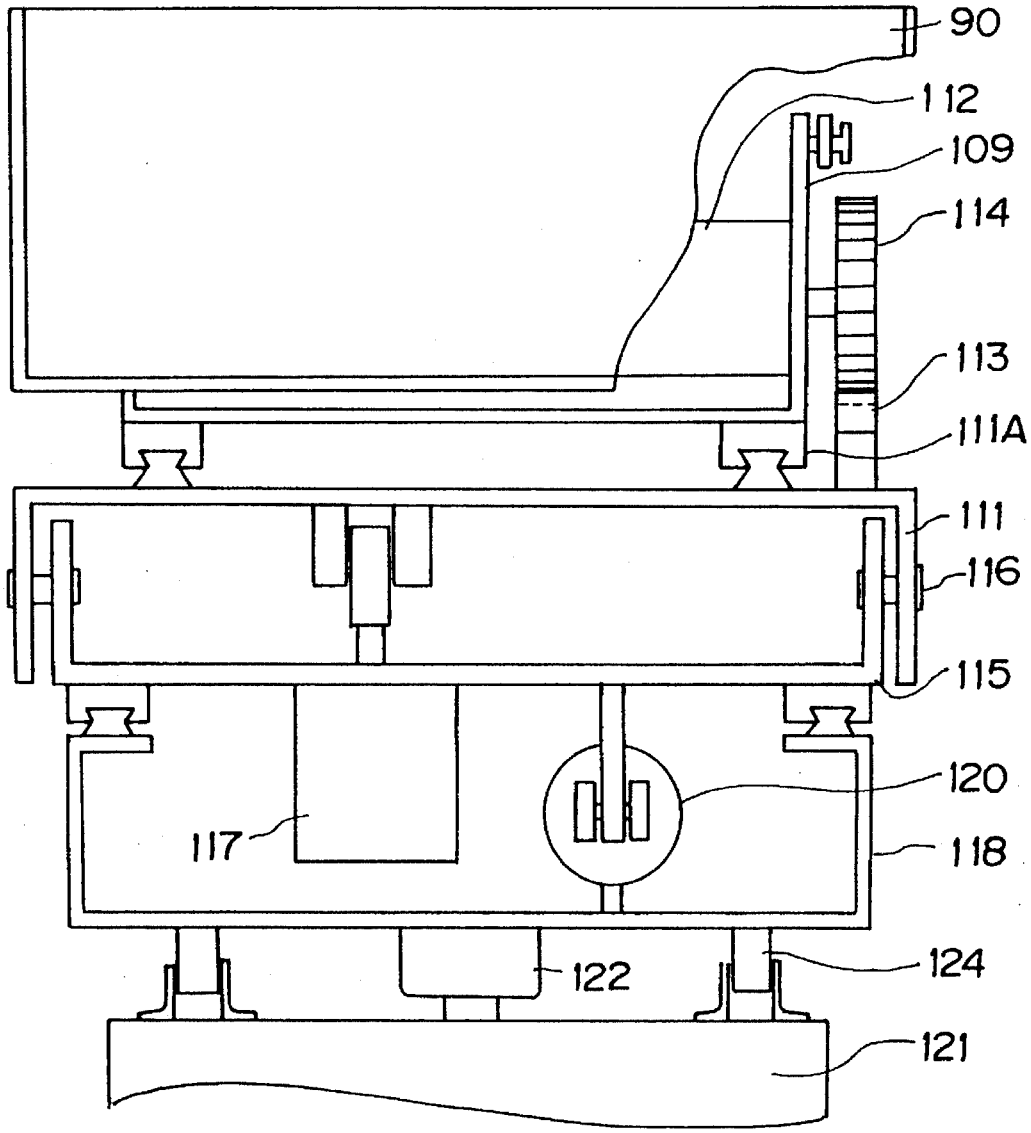
FIG. 7 is a schematic view showing a goods loader.

(D) Goods loader (see FIGS. 5 to 7)

The goods loader 18 has a goods push-out means 81. In the goods discharge position, the goods push-out means 81 pushes the goods collected on the goods reception conveyor 17 towards the goods feeder unit 80 which is located sidewise, then the goods is transferred into the container 83 from this goods feeder unit 80.

At this time, at least at the goods discharge position in the goods conveying path (i.e., a position, at which the U-shaped form of the goods receptacle 62A is adjusted by the U-shaped form adjuster 67) each goods receptacle member 62 has its opposite sides opened.

The position of discharge of goods from the goods reception conveyor 17 and the positions of transfer of goods to the goods reception table 80 and the container 83 are disposed along a line.

The position of transfer of goods to the container 83 is determined near one side of a container conveying line 19. At this position, a container form controller 84 is disposed such that it corresponds to the position of the goods reception table 80. The container form controller 84 has a container holder 86, which can be tilted upwardly by a cylinder 85 from a position beneath the roller conveyor of the container conveying line 19 through and between roller conveyors. The container 83, which is to be set at the goods transfer position, is tilted such that its opening 83A is brought to a position to face the goods reception table 80.

The push-out means 81 has a push-out plate 88 driven by a cylinder 87 which is supported on a base 17B. In the goods discharge position, the push-out plate 88 can be inserted into each goods receptacle member 62 from one side opening thereof to push out goods, the form of which has been adjusted in the goods receptacle 62A by the U-shaped form adjuster 67, through the other side opening of the goods receptacle 62.

The push-out plate 88 has a size, which is set to the smaller than (or substantially equal to) the rectangular opening of the goods receptacle member 62 that is formed by the opening unit 70 of the U-shaped form adjuster 67 noted earlier. Thus, it can be smoothly inserted in the rectangular opening noted above without interference with the goods receptacle member 62 and also without formation of a goods leak-out gap with respect to the goods receptacle member 62.

Further, the push-out plate 88 is set such that it does not get out of the goods receptacle 62A even in the process of ending the pushed out of goods in the goods receptacle 62A, and thus it can be returned to the initial position without interference with the goods receptacle member 62. Where the push-out plate 88 is to be advanced beyond the goods receptacle 62A, its opposite side flanges may be extended rearward so that they remain in the goods receptacle 62A in the pushed out ending process.

FIGS. 5 and 7 show a goods feeder unit 80. As shown, it includes a goods transferring member 90, a goods guide 91, a slide driver 92, a tilt driver 93, a tilt base slide driver 94, a revolution driver 95, and a lifter 96. The goods transferring member 90 is a box-like shape open on one side and at the top. The goods guide 91 serves to hold the leading end of goods that are pushed out from the goods receptacle member 62 to the goods transferring member 90 by the transferring plate 88, thus preventing the disturbance of the form of the goods. The slide driver 92 permits the goods transferring member 90 to slide to given extends in the directions of the goods receptacle member 62 and container 83. The tilt driver 93 permits tilting of the goods transferring member 90 together with the slide driver 92. The tilt base slide driver 94 permits the goods transferring member 90 to slide to a predetermined extent together with the slide driver 92 and tilt driver 93. The revolution driver 95 permits revolving of the goods transferring member 90 by 180 degrees in opposite directions together with the slide driver 92, tilt driver 93 and tilt base slide driver 94 from the position directed to the goods conveyor 17 to the position directed to the container 83. The lifter 96 can lift the goods transferring member 90 together with the slide driver 92, tilt driver 93, tilt base slide driver 94 and revolution driver 95 to change the height level of the goods transferring member 90 so as to be ready the position for the inserting of the goods transferring member 90 into the container 83.

The goods guide 91 has a rodless guide cylinder 102, which is movable along a horizontal guide 101 provided on the opposite side of the push-out means 81 of the base 17B, a lift cylinder 103 mounted on the guide cylinder 102, a lifter 105 to be moved vertically along the slide guide 104 by the guide cylinder 103, and a goods retainer 106 suspended from the lifter 105. Thus, with goods sandwiched between the push-out plate 88 and retainer 106, the goods guide 91 moves the push-out plate 88 and retainer 106 with cylinders 87 and 102 to push out the goods from the goods receptacle member 62 to the goods transferring member 90. The goods retainer 106 and push-out plate 88 are started to be moved at the same time and at the same speed, thus holding a constant distance between them. It is also possible to cause the goods retainer 106 to be started in response to the detection of the contact of the end portion of goods with the retainer 106 with a contact sensor or the like provided on the front surface of the retainer 106. With this arrangement, the goods are transferred in a state sandwiched between the retainer 106 and push-out plate 88. After the transfer of the goods to the goods transferring member 90 caused with advancement of the retainer 106 into the goods transferring member 90, the retainer 106 is withdrawn upward from the inside of the goods transferring member 90 with a lift cylinder 103 and then returned to the side of the goods reception conveyor 17. The rodless guide cylinder 102 for moving the horizontal guide is being capable of being stopped at an intermediate position. Thus, after the retainer 106 has been withdrawn upward, it is moved up to an intermediate stop position in front of the base 17B of the goods reception conveyor 17. Then, it is lowered by the lift cylinder 103 down to a position free from interference with the support member 61 of the goods reception conveyor 17. Then, the rodless cylinder 102 is driven again to the last end, thus moving the goods retainer 106 up to the immediate vicinity of the goods receptacle member. And then is moved up to the end of the rodless cylinder 102, i.e., up to the vicinity of the goods receptacle member 62. The goods retainer 106 also serves to close the other side opening of the goods receptacle member 62 to prevent goods from getting out of the goods receptacle 62A when moving the good reception conveyor 17.

In the slide driver 92, the goods transferring member 90 has its lower portion on the side opposite the opening rotatably supported by a shaft 108 on a slide frame 109. Also, the slot 110A of a support member 110, which is pin supported on an upper portion of the goods transferring member 90 on the same side, is coupled by a pin to an upper portion of a slide frame 109, whereby the goods transferring member 90 is lockably supported on the slide frame 109. Also in the slide driver 92, a slide guide 111A permits the slide frame 109 to be moved along the slide base 111. The slide frame 109 can be moved via a rack-and-pinion mechanism (i.e., with a rack 113 and a pinion 114) by driving a servo motor 112 provided on it.

In the tilt driver 93, the slide base 111 is pin supported by a tilt pin 116 on each outer side of a tilt base 115, and it can be tilted as it is raised by a tilt cylinder 117 provided on the tilt base 115.

In the tilt base slide driver 94, the tilt base 115 on a revolution frame 118 such that it is movable along a slide guide 119, that is, it is movable to a predetermined extent with the elongation or contraction of the slide cylinder 120 secured to the revolution frame 118. It is thus possible to reduce the distance, by which the goods transferring member 90 having been raised by the lifter 96 is spaced apart from the front of the container 83.

In the revolution driver 95, the revolution frame 118 is secured to a revolution shaft 122 provided in a lift frame 121, and it is reciprocable by 180 degrees by driving the revolution shaft 122 with a servo motor 123. It is supported by wheels 124 provided on the lift frame 121.

The lifter 96 has a lifter frame 121, which is supported by a link mechanism with two support arms 126 coupled in a crossed fashion to a lifter base 125. One of the support arms 126 is pin coupled to a mover 127 which is slidable over the lifter base 125. The other arm 126 is slidably pin coupled to a slot formed in the lifter frame 121. The lifter frame 121 is moved vertically with the raising and lowering of the support arms 126 caused with movement of the mover 127, which is in turn caused with rotation of a ball screw 129, on which the mover 127 is screwed, with the operation of a servo motor 128.

Thus, the goods loader 18 operates as follows.

(a) Goods collected on the goods receptacle member 62 on the goods reception conveyor 17 arrive at a goods delivery position. At this time, the U-shaped form adjuster 67 adjusts the U-shaped form of the goods receptacle 62A, and the retaining member 70B of the opening unit 70 form in one side opening of the goods receptacle member 62 a rectangular opening for inserting the push-out means 81 thereinto and also sets the form of the collected goods in the goods receptacle 62A to one fitted to the opening 83A of the container 83 (FIG. 8A).

Figure 8A:
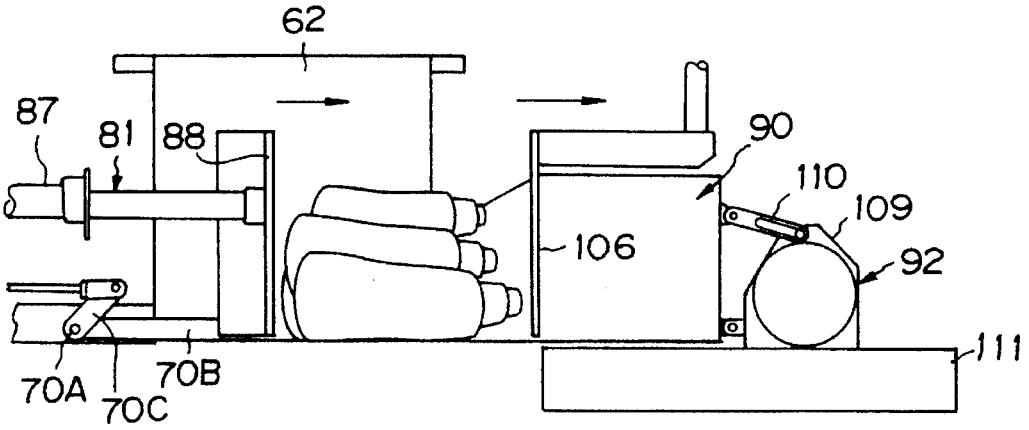
FIGS. 8A to 8C are schematic views showing an operation of transferring goods from the goods receptacle member to a goods transferring member.

(b) The push-out plate 88 of the push-out means 81 is inserted into the U-shaped goods receptacle 62A through one side opening of the goods receptacle member 62, whereby the collected goods in the goods receptacle 62A are sandwiched between the push-out plate 88 and the retainer 106 of the goods guide 91 and are pushed out by the push-out plate 88 to the side of the goods transferring member 90 of the goods feeder unit 80 (see FIG. 8A). At this time, the goods transferring member 90 is driven by the slide driver 92 to project from the front edge of the slide base 111 toward the goods reception conveyor 17 so as to be ready for smoothly receiving goods pushed out from the goods receptacle 62A.

Figure 8B:
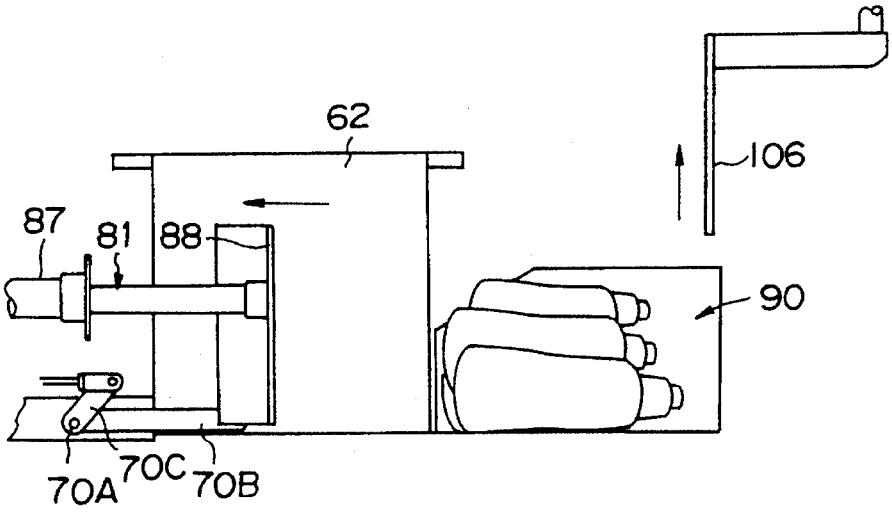
Figure 8C:
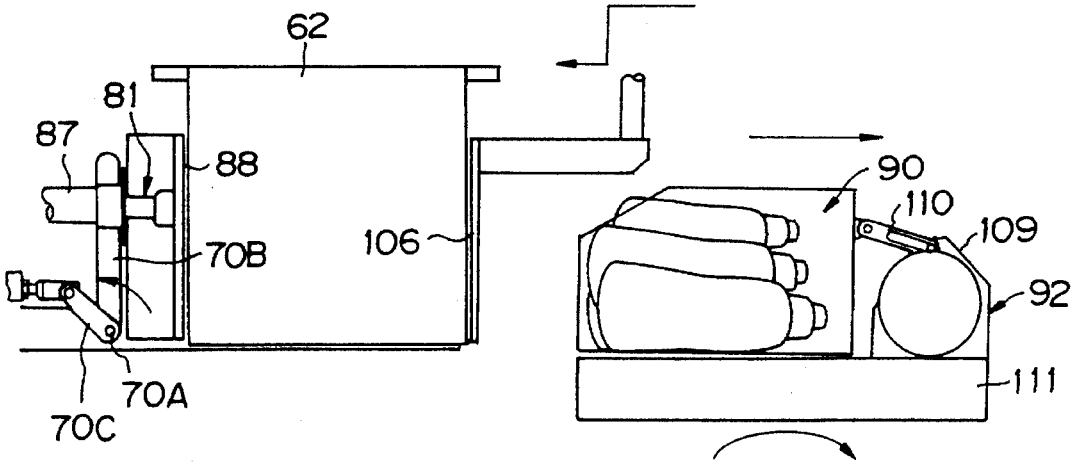

(c) After the goods have been transferred to the goods transferring member 90, the goods transferring member 90 is withdrawn into the slide base 111 by the slide driver 92. Then, the push-out plate 88 is returned to the side of the goods receptacle member 62 (FIG. 8B), and then the retaining member 70B are returned to the outside of the goods receptacle member 62 (FIG. 8C). At the same time, the retainer 106 is withdrawn upwardly of the goods transferring member 90 (FIG. 8B). Then, the goods retainer 106 is returned to an intermediate position in front of the base 17B of the goods reception conveyor 17, then lowered down to a position free from interference with the support member 61 of the goods reception conveyor 17, and then returned to the final stop position in the vicinity of the goods receptacle member 62 (FIG. 8C).

Figure 9A:
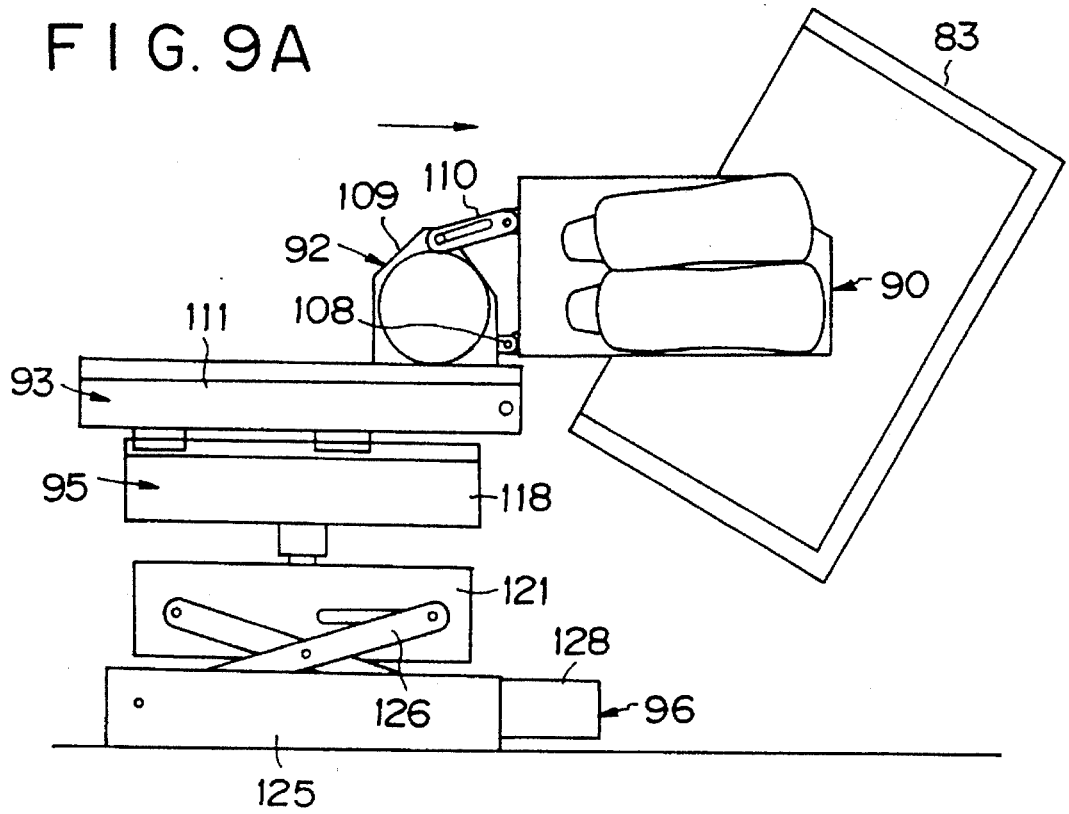
FIGS. 9A and. 9B are schematic views showing an operation of transferring goods from the goods transferring member to a container.

(d) Independently of the steps (a) to (c), the container form controller 84, which is provided at the position of transfer of goods to the container 83 such as to face the goods feeder unit 80, selects the container 83 for accommodating goods thereinto according to bar code information provided on the container 83, and causes tilting of the container 83 to bring the opening 83A thereof to a position to face the goods feeder unit 80 (FIG. 9A).

At this time, if the container 83 contains goods already accommodated therein, the contained goods are supported on lower side wall portion of the container 83, thus forming an empty space free from goods in an upper portion of the container 83.

(e) The goods that have been transferred to the goods transferring member 90 in the above step (c), are transferred to the empty container 83 as follows.

Figure 9B:
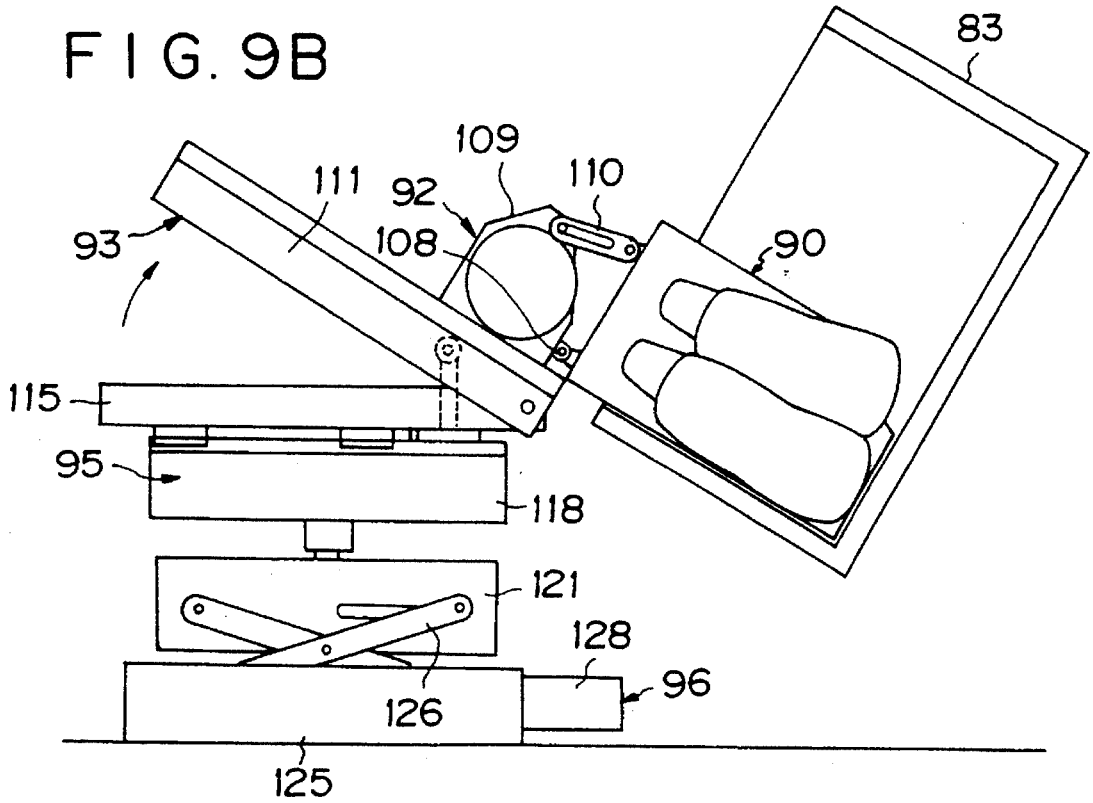
Figure 10A:
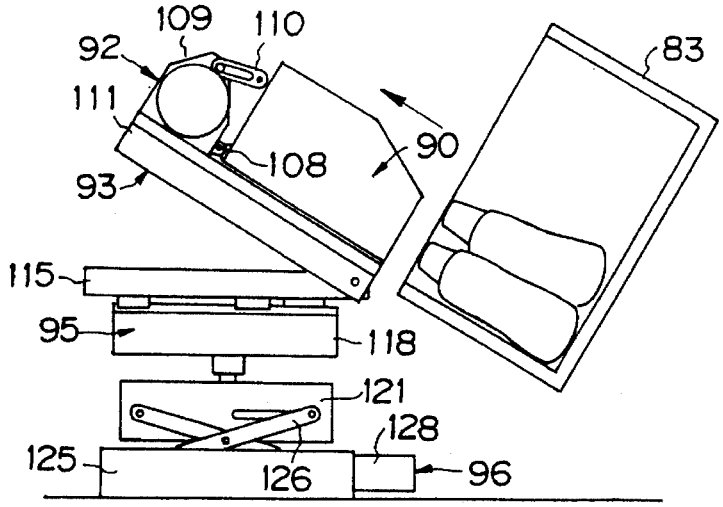
FIGS. 10A to 10C are schematic views showing an operation of transferring goods from the goods transferring member to a container.
Figure 10B:
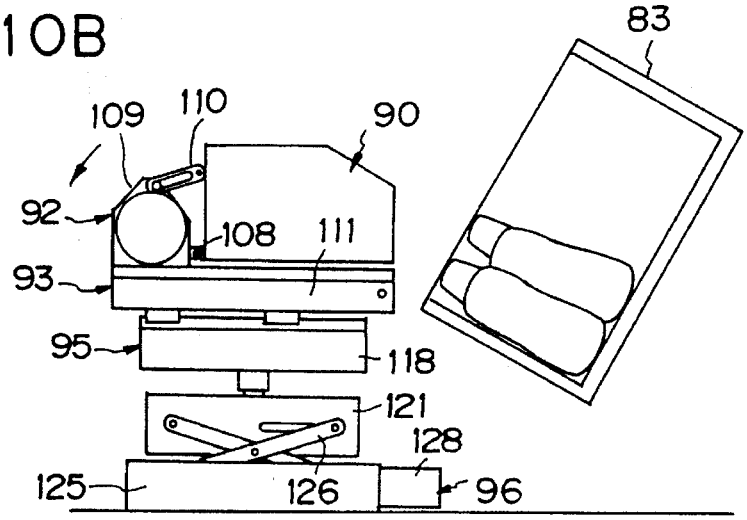
Figure 10C:
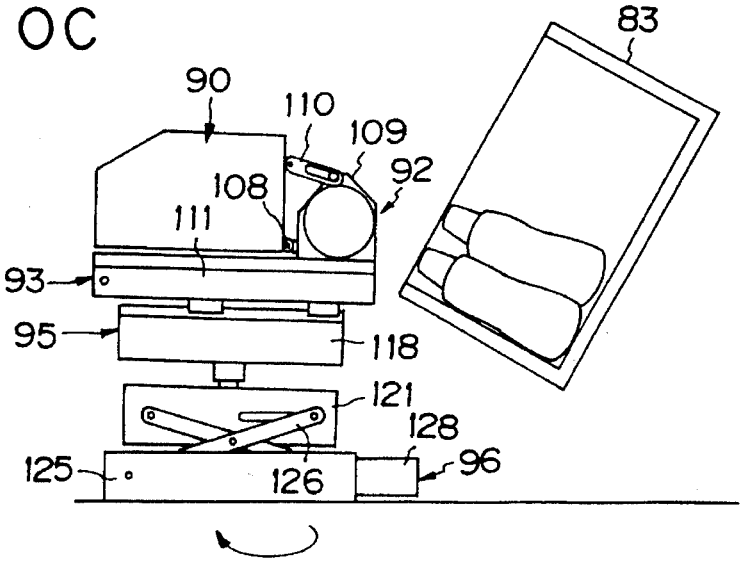

The goods transferring member 90 in the state shown in FIG. 8C, is driven by the revolution driver 95 for revolution by 180 degrees toward the container 83 and then driven by the slider driver 92 for movement toward the container 83 to be inserted into the container 83 (FIG. 9A). Then, it is tilted by the tilt driver 93 together with the slide driver 92 to let the goods be supported on the bottom of the container 83 (FIG. 9B). Thereafter, the goods transferring member 90 is driven by the slide driver 92 away from the container 83. In this way, the goods transferring member 90 is withdrawn while leaving the goods in the container 83 (FIG. 10A). In this operation, the goods transferring member 90 is inserted up to the depth of the container 83, thus reducing the distance, by which goods can be moved freely. This means that the form of goods is less liable to be deformed. After the goods transferring member 90 has been withdrawn, the tilt driver 93 is returned (FIG. 10B), and then the goods transferring member 90 is returned to the state shown in FIG. 8A with its 180-degree rotation caused toward the goods reception conveyor 17 as shown in FIG. 10C by the revolution driver 95. Thereafter, the above sequence of operations is repeated.

(f) The goods having been transferred to the goods reception member 92 in the above step (c), are transferred to the container 83, which already contains goods as follows.

This operation is different from the operation in the step (e) in the case, in which the container 83 is empty, in that the goods transferring member 90 with goods transferred thereto in the step (c) is raised and inserted into an upper portion of the container 83. Specifically, concurrently with the 180-degree revolution of the goods transferring member 90 by the revolution driver 95 in FIG. 8C toward the container 83, the goods transferring member 90 is raised by the lifter 96 up to about one half the height level of the opening of the container 83 at the time. Then, the goods transferring member 90 is driven toward the container 83 by the tilt base slide driver 94, and then as in the step (e), the goods transferring member 90 is inserted into the container 83 (i.e., into a portion thereof above the already contained goods). Then, it is tilted and withdrawn to set new goods on the already contained goods.

Figure 11:
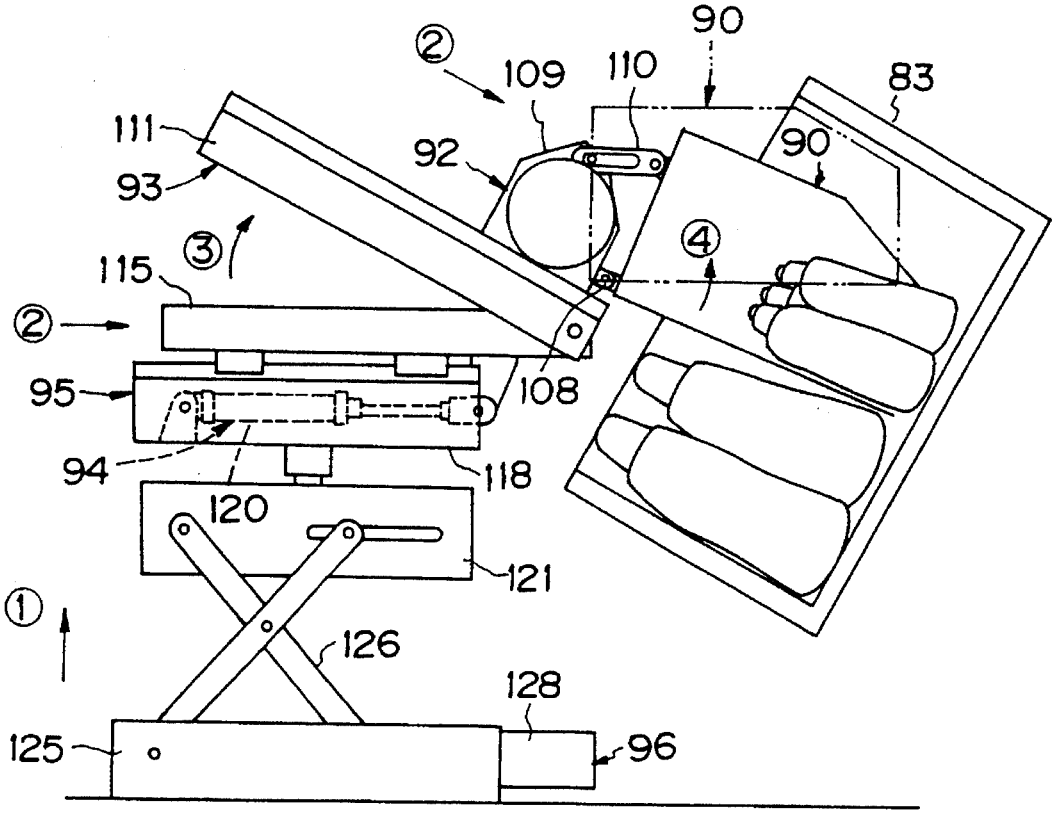
FIG. 11 is a schematic view showing an operation of transferring goods from the goods transferring member to a container.

At this time, lest the already contained goods should not collapse when touched by the goods transferring member 90, the member 90 is adapted to escape upward with its pin coupling to the slide frame 109 via the slot 110A of the support member 110. That is, the goods transferring member 90 is rotated about the shaft 108 (FIG. 11).

The level, to which the goods transferring member 90 is raised, depends on whether the quantity of the already contained goods is ① zero, ② up to one half the container volume or ③ above that volume (but less than the container volume). In the case ①, the level is referred to as low level (substantially the same as the level of the lower side wall of the container), in the case ② it is referred to as intermediate level (substantially one half the level of the container opening), and in the case ③ it is referred to as upper level (about three-fourth of the container opening level). Goods to be accommodated in individual containers 83 are allotted to the containers 83 by calculating the volume of goods so that each allotted quantity of goods is less than the container volume. The level, to which each goods transferring member is to be raised with respect to each container, is preliminarily calculated by a computer, and the calculated data is transferred together with drop-out quantity data of each drop-out unit to a goods collection unit controller not shown) to be supplied to the goods loader in a timed elation to the progress of transfer of goods to containers. In the case ③, the goods transferring member 90 an not be sufficiently inserted into the depth of the ontainer, but the goods are less disturbed because of a small empty space. The above method of determining the level, to which the goods transferring member 90 is to be raised, is by no means limitative; for example, the goods transferring member 90 may be raised to a necessary extent by detecting the empty space in the container 83 with a photo-switch, a visual sensor, etc.

In the above step (d) of tilting the container 83, if the container 83 is tilted such that its longitudinal direction is directed in the vertical direction, it is possible to suppress the spread of goods to the left and right in the container 83. In this case, the form of goods in the container 83 is less disturbed, and also the empty space (i.e., the height level thereof) can be increased, thus facilitating the insertion of the goods transferring member 90 into the container 83.

(F) Container conveying line 19 (see FIGS. 1 and 5)

The container conveying line 19 passes by a plurality of goods collection units 10A, and is a roller conveyor which extends past the position of goods transfer from goods transferring member 90 of the goods feeder unit 80 to the goods conveyor 83.

The container conveying line 19 is provided with a bar code reader 98 and also with stoppers 99A and 99B which are located upstream and downstream of the container form controller 84, respectively.

The pick-out controller, as noted before reads a bar code applied to each container 83 and judges that the pertinent container 83 is one, in which to load goods. When it is found that the container 83 is for loading goods therein, this container is stopped by the downstream side container 99A, and at the same time the succeeding containers 83 are also stopped by the upstream side container 99B. Then, the pertinent container 83 is tilted by the container form controller 84 into a turned-down state such that the opening 83A of the container 83 faces the goods feeder unit 80.

In the container conveying line 19, a roller conveyor is disposed one one side of the goods collection unit 10A such that it is inclined slightly (by 5 to 10 degrees) so that the container 83 is conveyed in a tilted state. Goods contained in the container 83 thus can be conveyed in a state gathered one side wall of the container to the next goods collection unit 10A. Thus, unstable goods, such as flat bolts, may as well be conveyed without possibility of being turned down in the container 83, and an empty space, into which goods are to be inserted, can be formed stably in an upper portion of the container 83.

Figure 12:
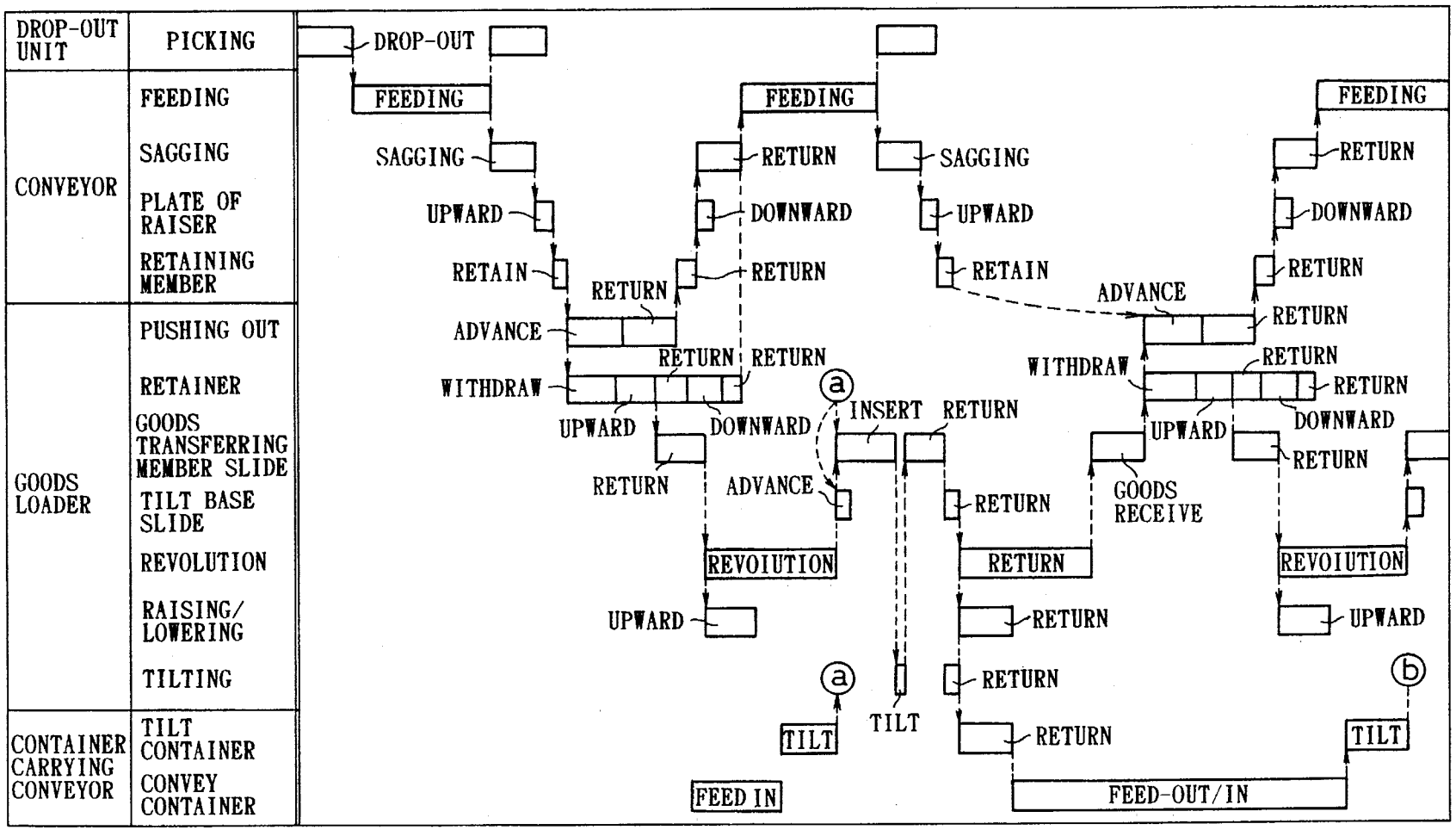
FIG. 12 is a flow chart showing a goods collection process in a picking apparatus.

The specific operation procedure of the picking apparatus 10 is as in (1) to (4) below (see FIG. 12).

(1) Operation of the goods drop-out units 14

(1) The pick-out controller outputs drop-out goods amount data to corresponding goods drop-out units 14.

② Each goods drop-out unit 14 drops out a predetermined number of goods. The dropped-out goods are supplied via guide and stationary chutes 15 and 16 to a predetermined number of goods. The dropped-out goods are supplied via guide and stationary chutes 15 and 16 to a predetermined goods receptacle member 62 on the goods reception conveyor 17.

② Operation of goods reception conveyor 17

① The goods reception conveyor 17 is moved intermittently to bring individual goods receptacle members 62 to successive positions in front of a plurality of goods drop-out units 14 and proceeds to the goods discharge position while accommodating goods that may be dropped out from certain goods drop-out units 14 as in the step (1) noted above in pertinent goods receptacle members 62.

② When each goods receptacle member 62 arrives at the goods discharge position, the U-shaped form of the U-shaped goods receptacle 62A is adjusted by the support point distance adjuster 68, raiser 69 and opening unit 70 of the U-shaped form adjuster 67, whereby they can form a rectangular opening for inserting the push-out means 81 in one side opening of the goods receptacle member 62, and the form of the goods in the goods receptacle 62A is set to one fitted to the opening 83A of the container 83 to be discharged.

(3) Operation of goods loader 18

① At a goods discharge position, the goods that have been collected on each goods receptacle member 62 on the goods reception conveyor 17, are pushed by the goods push-out means 81 and thus transferred onto the goods transferring member 90 of the goods feeder unit 80 disposed sidewise. At this time, the goods are sandwiched between the goods push-out means 81 and goods pushers 106 and thus transferred to the goods transferring member 90 without disturbance of their collected form in the goods receptacle 62A. The goods transferring member 90 has been projected from the front edge of the slide base 111 toward the goods reception conveyor 17 by the slide driver 92, and the goods pushed out from the goods receptacle 62A can be smoothly received.

② The goods that have been transferred to the goods transferring member 90 in the above step ①, are transferred to the empty container 83 in the following operation. First, the goods transferring member 90 is withdrawn by the slide driver 92 into the slide base 111. Then, the goods transferring member 90 is caused to be evolved by 180 degrees toward the container 83 by the revolution driver 95. Then the goods transferring member 90 is inserted into the container 83 by the slide driver 92. Then, the goods transferring member 90 is tilted together with the slide driver 92 by the tilt driver 93, thus causing the goods to be supported on the bottom of the container 83. Then, the goods transferring member 90 is moved by the slide driver 92 away from the container 83, whereby the goods transferring member 90 is withdrawn while leaving the goods alone in the container 83.

③ When adding goods that have been transferred to the goods transferring member 90 in the above step ① to the container 83, which already contains goods transferred to it, the operation is different from that in the step ② as follows. After the goods transferring member 90 has been withdrawn into the slide base 111 by the slide driver 92, the goods transferring member 90 is raised by the lifter 96 simultaneously with its 180-degree revolution toward the container 83 caused by the revolution driver 95. Then, the goods transferring member 90 is brought toward the container 83 by the tilt base slide driver 94. Then, as in the step ②, the goods transferring member 90 is inserted into a space in the container 83 above the contained goods, and then it is tilted and withdrawn, thus effecting the transfer of new goods set on the goods that have been initially contained.

(4) Operation of container conveying line 19

① Whether a container 83 is one in which to load goods, is judged by reading out a bar code on the container 83.

② If the container 83 is one which to load goods, it is tilted by the container form controller 84 to a position, at which the opening 83A of the container 83 faces the goods feeder unit 80.

③ In the step (3) noted above, the goods transferred by the goods transferring member 90 are brought into the container 83.

④ After the goods are loaded in the container 83, the container 83 is brought back by the container form controller 84 to the tilted roller conveyor of the container conveying line 19.

⑤ The container 83 is then conveyed to the next step in the tilted state toward the goods collection unit 10A by the tilted roller conveyor.

The functions of this embodiment will now be described.

① Since the goods receptacle 62A on the conveyor 17 is flexible, it can absorb shocks produced at the time of the transfer of goods to it with its flexing deformation, and thus it is possible to reduce damage to the goods and noise generation. In addition, since the goods receptacle 62A is flexible, it can undergo flexing deformation such as to fit the form of the transferred goods. Thus, it can hold goods in a neatly arranged form; for example, it can hold a plurality of goods neatly and stably such that the longitudinal direction of the goods is aligned.

② By outwardly opening the opposite sides of the bottom of the flexible goods receptacle member 62 with the opening unit 70, as rectangular or like definite shape (and fixed size) opening can be formed reliably in one side opening of the goods receptacle member 62. The flexible goods receptacle member 62 thus does not become indefinite in shape or sag inward in the U-shaped form. Thus, it is possible to smoothly insert the pushing unit (i.e., push-out plate 88) into the goods receptacle member 62 through the above definite shape opening.

③ Since the opening having a definite size is formed in one side opening of the goods receptacle member 62, by setting the size of the pushing unit (i.e., push-out plate 88) to match the size of the definite shape opening, it is possible to prevent goods from getting out through a gap between the goods receptacle member 62 and pushing unit (i.e., push-out plate 88). Further, since the goods receptacle member 62 is opened and held open by the opening unit 70, at the time of pushing goods with the pushing unit (i.e., push-out plate 88), the goods receptacle member 62 is held by the opening unit 70 and not carried along with the goods. Thus, it is not deformed, that is, no gap is formed, through which goods may get out, with respect to the pushing unit (i.e., push-out plate 88).

④ As the goods transferring member 90 with goods accommodated therein is inserted into an upper empty space in the tilted container 83 and withdrawn in its downwardly tilted state to the outside of the container 83, the goods can be inserted into the container 83 while the goods are held in their form (i.e., arranged form) on the goods trans erring member 90.

⑤ When the container 83 already contains goods transferred into it earlier, the tilting of the container 83 causes the contained goods to be gathered onto the lower side wall of the container 83 to form an empty space in an upper portion of the container 83. This empty space serves as a space for adding subsequent goods to the container 83 by inserting the goods in the manner as in the above step ⑦. That is, it is possible to goods collected in a plurality of goods receptacles 62A on the conveyor 17 successively into one container 83 or add goods to those which have already been inserted into the container 83 from the goods collection unit 10A. It is thus possible to improve the accommodation efficiency of the container 83 and also the goods collection capacity of the goods collection line.

⑥ With the container 83 conveyed between adjacent goods loaders 18 in a state tilted toward the goods loaders 18, the goods contained in the container 83 can be conveyed to the next goods loader 18 while being held in a state gathered on the lower side wall of the container 83. Thus, unstable goods, such as flat bolts, can as well be held in an arranged form without possibility of being turned down in the container 83, thus improving the property of handling goods in the subsequent process. Further, since the goods in the container 83 are not turned down, an empty space, into which additional goods are to be inserted in the next goods loader 18, can be stably secured in an upper portion of the container 83.

As has been described in the foregoing, according to the invention, when transferring goods from the goods transferring member to the container, the goods can be transferred to the container in a neatly arranged form. In addition, it is possible to insert additional goods to the container.

Further, according to the invention, it is possible to convey containers successively to a plurality of goods loaders without possibility of disturbance of the arranged form of goods in the containers.

Although the invention has been illustrated and described with respect to several exemplary embodiments thereof, it should be understood by those skilled in the art that the foregoing and various other changes, imissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A method of transferring goods to containers with goods loaders, the method comprising the steps of:

tilting a container toward the goods loaders;

inserting a goods transferring member with goods accommodated therein into an empty space in the tilted container by moving the goods transferring member while holding the goods transferring member substantially in a horizontal state in accord with a height level of the empty space; and tilting the goods transferring member downward and withdrawing the goods transferring member in the tilted state to the outside of the container, thus effecting the transfer of the goods in the goods transferring member to the container.

2. The method of transferring goods to containers according to claim 1, wherein the goods loaders are disposed at each of a plurality of positions along a conveying line for conveying the containers therealong, the containers being conveyed between adjacent goods loaders in a state tilted toward the goods loaders while goods are successively transferred to the containers by each goods loader.

3. The method of transferring goods to containers according to claim 1, further comprising a step of accommodating the goods in a goods transferring member having a box-like shape open on one side and at the top.

4. The method of transferring goods to containers according to claim 2, further comprising a step of accommodating the goods in a goods transferring member having a box-like shape open on one side and at the top.

5. An apparatus for transferring goods to containers with a goods loader comprising:

a container orientation controller for tilting a container toward the goods loader;

a goods transferring member for accommodating goods; and a goods transferring member operating unit for causing the goods transferring member to be ready for insertion into an empty space in the container in a tilted state, for moving the goods transferring member while holding the goods transferring member substantially in a horizontal state in accord with a height level of the empty space into the tilted container, and for tilting the goods transferring member downward to make it ready for withdrawing the goods transferring member in the tilted state to the outside of the container to effect transfer of goods into the container.

6. The apparatus for transferring goods to containers according to claim 5, wherein the goods transferring member has a box-like shape open on one side and at the top.

7. A goods transfer apparatus for transferring goods from a goods reception conveyor to containers with a goods loader comprising:

a container orientation controller for tilting a container toward the goods loader; and a goods transferring member for accommodating goods;

the goods loader serving to push goods collected in the goods reception conveyor with goods push-out means at a goods discharge position so as to push out the goods to a goods feeder unit disposed sidewise so that the goods can be transferred from the goods feeder unit to a container;

the goods feeder unit including:

a slide driver for causing movement of the goods transferring member to given extents in the both directions of the goods receptacle member and the container;

a tilt driver for causing the goods transferring member to be tilted together with the slide driver;

a tilt base slide driver for causing the goods transferring member to be moved to a predetermined extent together with the slide driver and the tilt driver;

a revolution driver for causing the goods transferring member to be revolved by 180 degrees together with the slide driver, the tilt driver and the tilt base slide driver from a state directed to the goods reception conveyor to a state directed to the container; and a lifter for raising and lowering the goods transferring member together with the slide driver, the tilt driver, the tilt base slider driver and the revolution driver to change the level height of the goods transferring member, thereby raising and lowering the position of insertion of the goods transferring member into the container.

8. A method of collecting goods in a container using the goods transfer apparatus comprising the steps of:

causing a goods transferring member to be projected toward a goods reception conveyor with a slide driver for receiving goods pushed out from the conveyor;

after the transfer of the goods to the goods transferring member, causing the goods transferring member to be withdrawn toward the container with the slide driver;

the goods transferring member being caused by the revolution driver to be revolved by 180 degrees toward the container when the container is empty, and when the container is not empty, the goods transferring member being caused by the revolution driver to be revolved by 180 degrees toward the container and at the same time caused by the lifter to be raised up to a position above goods having already been inserted in the container;

then causing the goods transferring member to be moved and inserted into the container by the slide driver;

then causing the goods transferring member to be tilted together with the slide driver by the tilt driver, thus causing the goods to be supported by the bottom of the container;

then causing the goods transferring member to be moved away from the container by the slide driver, thus withdrawing the goods transferring member while leaving the goods alone in the container; and after the withdrawal of the goods transferring member, returning the tilt driver and causing the goods transferring member to be revolved by 180 degrees toward the goods reception conveyor by the revolution driver, thus returning the goods transferring member to the initial position.

* * * * *